United States Patent [19]

Mody

[11] Patent Number: 4,847,726

[45] Date of Patent: Jul. 11, 1989

[54] MAGNETIC ACTUATOR

[75] Inventor: Hemant K. Mody, Rochester, N.Y.

[73] Assignee: Eastman Kodak Company, Rochester, N.Y.

[21] Appl. No.: 132,731

[22] Filed: Dec. 14, 1987

[51] Int. Cl.[4] ..... H01F 7/08

[52] U.S. Cl. ..... 361/147; 335/234; 335/306; 354/234.1

[58] Field of Search ..... 361/143, 147, 148; 354/234.1, 235, 248, 249; 335/234, 306

[56] References Cited

U.S. PATENT DOCUMENTS

| | | | |
|---|---|---|---|
| 3,458,769 | 7/1969 | Stampfli | 361/147 |
| 3,634,735 | 1/1972 | Komatsu | 361/147 |
| 3,987,473 | 10/1976 | Kondo | 354/234 |
| 4,011,003 | 3/1977 | Dragt | 350/6 |
| 4,051,499 | 9/1977 | Kondo | 354/234.1 |
| 4,313,659 | 2/1982 | Saito et al. | 354/234.1 |
| 4,458,227 | 7/1984 | Petersen | 354/234.1 |
| 4,514,065 | 4/1985 | Carrera | 354/235.1 |

*Primary Examiner*—Michael L. Gellner

*Attorney, Agent, or Firm*—Donald D. Schaper

[57] ABSTRACT

A magnetic actuator is disclosed in which a member formed of a magnetic material is movable relative to a frame along a predetermined path. Magnets are located on the frame at opposite ends of the path. In order to keep the mass of the movable member as small as possible, no magnetic elements are located on the member. Permanent magnets function with the magnets at opposite ends of the path to move the member, support the member along one degree of freedom, and hold the member in a rest position.

12 Claims, 4 Drawing Sheets

MAGNETIC ACTUATOR

CROSS REFERENCE TO RELATED APPLICATIONS

Reference is made to commonly-assigned U.S. patent application, Ser. No. 132,732, entitled Axial Magnetic Actuator, filed in the name of Hemant K. Mody on even date herewith, and to commonly-assigned U.S. patent application, Ser. No. 132,744, entitled Exposure Control Device, filed in the name of Hemant K. Mody on even date herewith.

BACKGROUND OF THE INVENTION

1. Field of the Invention

The present invention relates to a magnetic actuator, and more particularly, to such an actuator which is particluarly suitable for use in high-speed, precision applications.

2. State of the Prior Art

Magnetic actuators are known for moving elements in various types of mechanisms. In certain of these mechanisms, it is desirable for the movable element to be as light as possible, to move silently, and to move with a minimum of friction. One of the problems in magnetic actuators of a bidirectional type is that a magnetic element, such as a coil or a permanent magnet, must be incorporated in the movable element; this increases the mass of the element and hence the power requirements of the actuator.

In U.S. Pat. No. 4,051,499, there is disclosed a magnetic actuator in a focal plane shutter having leading and trailing blinds made of an opaque plastic sheet material. A thin permanent magnet is sealed in each of the blinds. A series of electromagnetic coils are located along the path of each blind, and the coils are sequentially energized to drive the blinds in accordance with the principle of a linear motor. Such an arrangement has the disadvantage that complex drive electronics are required to regulate the current in the series of electromagnetic coils. It also has the disadvantage noted above, that is, the movable elements have a relatively high mass as a result of the magnets being incorporated in the blinds.

SUMMARY OF THE INVENTION

It is an object of the invention to overcome the problems in the prior art and to provide a magnetic actuator which has improved operating characteristics.

In accordance with one aspect of the present invention, there is provided a magnetic actuator for providing a driving force along a predetermined path, the actuator comprising: a member formed of a magnetic material; magnetic means for forming a magnetic circuit adjacent the member which is adapted to hold the member in at least one position; and means for creating an imbalance in the circuit to effect relative movement between the member and the magnetic means.

In one embodiment of the present invention, a member formed of a magnetic material is adapted to be moved along a predetermined path between two locations. An electromagnet is disposed adjacent each of the locations. One permanent magnet is disposed generally parallel to the path and above the member, and a second permanent magnet is disposed generally parallel to the path and below the member. The electromagnets are energized in timed relation by electrical pulses to move the member between the two locations.

An advantage of the present invention is that the magnetic circuit incorporates the permanent magnets in a manner to provide two features: (1) magnetic suspension along one degree of freedom; and (2) a magnetic energy minimum at a desired rest position. The first feature, combined with the low mass of the member, imposes minimal power requirements on the electromagnets. The second feature ensures that no current is required to maintain the member in a rest position. Other advantages of the invention are: dynamic braking is not required; low-peak power is required to drive the actuator; and the actuator can be driven with a very simple drive waveform.

Other features and advantages will become apparent with reference to the following Description of the Preferred Embodiments when read in light of the attached drawings.

DESCRIPTION OF THE PREFERRED EMBODIMENTS

Figure 1:
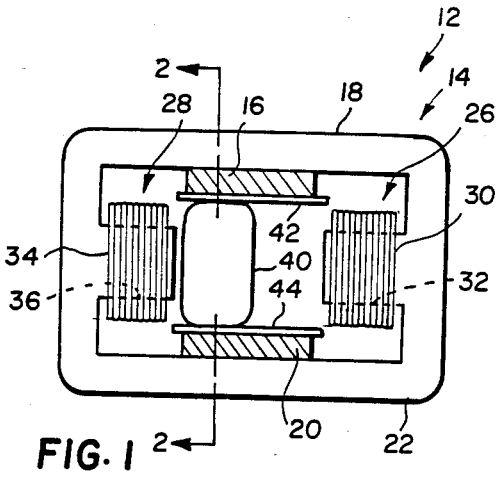
FIG. 1 is a front elevational view of a magnetic actuator of the present invention.

In FIG. 1, there is shown a magnetic actuator 12 constructed in accordance with the present invention. Actuator 12 comprises a frame 14, a permanent magnet 16 fixed to a top frame member 18, and a permanent magnet 20 fixed to a bottom frame member 22. Electromagnets 26 and 28 are disposed at opposite sides of shutter 12, as viewed in FIG. 1. Electromagnet 26 includes a coil 30 and a core 32 which is integral with 14, and electromagnet 28 includes a coil 34 and a core 36 which is also integral with frame 14. A member 40 is movable on tracks 42 and 44 between a first position adjacent coil 34, shown in FIG. 1, and a second position adjacent coil 30. Frame 14 and member 40 can be made from any magnetizable material, for example, silicon steel, permalloy, or mu metal. The frame 14 provides a low reluctance path for the flux from permenant magnets 16 and 20 and electromagnets 26 and 28, and frame 14 also serves to define the air gap between member 40 and electromagnets 26 and 28.

Figure 3:
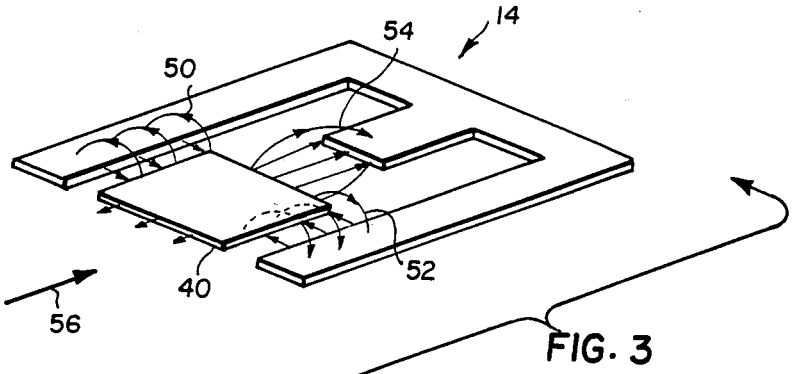
FIG. 3 is a perspective view of the frame of the actuator showing lines of force from the permanent magnets.

The two permanent magnets 16 and 20 produce magnetic fields which combine to form a magnetic circuit in which member 40 operates. In FIG. 3, lines 50 and 52 indicate, schematically, the directions of lines of force of permanent magnets 16 and 20, respectively, and lines 54 indicate, schematically, the direction of lines of force produced by the combined effect of magnets 16 and 20. The lines of force indicated by lines 54 tend to move member 40 in the direction of arrow 56 and along an X axis as shown in diagram 49. As shown in FIG. 3, the magnetic fields of permanent magnets 16 and 20 tend to oppose each other; this causes the flux leaving magnets 16 and 20 along the Y axis to gradually bend in the direction of the X axis. Thus, if member 40 is closer to, for example, electromagnet 26, the flux leaving the edge of the member 40 closer to electromagnet 26 is greater than that leaving the edge of member 40 facing electromagnet 28. This causes a magnetic energy differential which renders the member 40 bistable along the X axis, that is, along the path of movement.

The motion of member 40 is effected by energizing coils 30 and 34 in a manner such as to buck and boost the magnetic field at the trailing and leading edges, respectively, of the member 40. The direction of motion is determined by the direction of current in coils 30 and 34. Thus, assuming that member 40 is resting adjacent coil 30 at the start of operation, coils 30 and 34 are energized so that the flux emanating from the side of member 40 adjacent coil 30 is bucked and the flux on the side of member 40 nearest coil 34 is enhanced; this causes member 40 to move toward coil 34. Reversing the current direction in coils 30 and 34 causes the member 40 to move in the opposite direction. Thus, it will be seen that electromagnets 26 and 28 serve as a means for creating an imbalance in the magnetic circuit to effect the movement of member 40. Although coils 30 and 34 are shown as separate elements, the coils could be formed from one continuous conductor, since they are both energized with current of the same polarity.

Figure 6A:
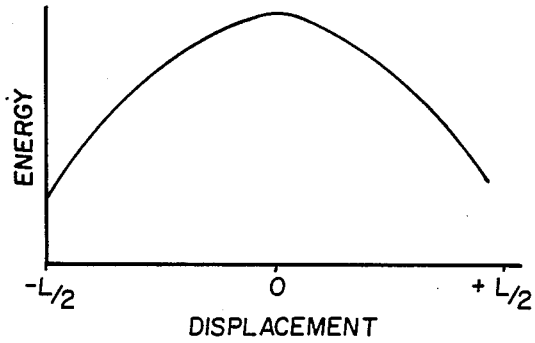
FIG. 6A is a plot of stored energy versus displacement of the driven member when the electromagnets are deenergized and one permanent magnet is polarized in a direction opposite to the other permanent magnet.
Figure 7:
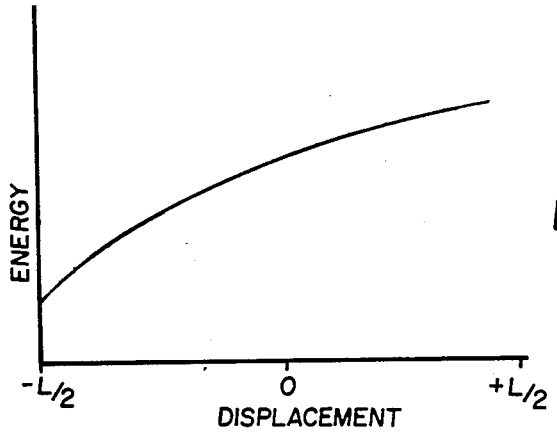
FIG. 7 is a plot of stored energy versus displacement of the driven member when the electromagnets are energized to move the member to the left.

In FIG. 6A there is shown a representation of the stored energy in the magnetic circuit when coils 30 and 34 are not energized. The total displacement of member 40 along its path of travel is considered to be L, with 0 designating a midpoint in the path of travel, $-L/2$ designating a position at one end of the path, and $L/2$ designating a position at the opposite end of the path. Member 40 moves to the position of least energy which is at either end of the curve, that is, at position $-L/2$ or $L/2$. To effect movement of member 40, for example from position $L/2$ to $-L/2$, coils 30 and 34 are energized which produces stored energy in the circuit as shown by the curve in FIG. 7. The current in coils 30 and 34 is reversed to effect movement of member 40 from $-L/2$ to $L/2$; in this case, the stored energy curve (not shown) would be the reverse of the curve shown in FIG. 7, that is, high energy at $-L/2$ and low energy at $L/2$.

The force on the member 40 due to the permanent magnets 16 and 20 increases rapidly as the air gap between member 40 and one of the electromagnets 26, 28, decreases. At the end of the stroke of member 40, the force on the member 40 can be large enough to prevent a noticeable bounce. As a result of this force, no dynamic braking is required in actuator 12. In many prior-art actuators, it is necessary to provide dynamic braking by, for example, reversing the current near the end of the stroke, in order to prevent bounce of a movable member. The force on member 40 due to magnets 16 and 20 also has the effect of reducing the power requirements of the electromagnets 26 and 28. In one representative example, magnets 16 and 20 are selected such that each magnet 16, 20, produces a force equivalent to the force produced by one of the electromagnets 26, 28, and thus, the power requirements are reduced by one-half.

Figure 6B:
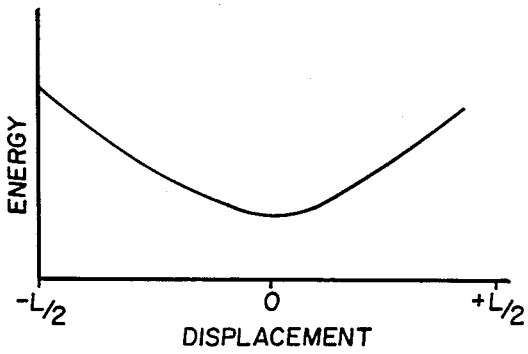
FIG. 6B is a plot of stored energy versus displacement of the driven member when the electromagnets are deenergized and both permanent magnets are polarized in the same direction.

The effect of having magnetic energy minima at the end of the stroke of member 40, as shown in FIG. 6A, ensures a bistable member, that is, no current is required to maintain the member in either of the two positions $-L/2$, $L/2$. It is also possible for member 40 to be monostable, that is, to be maintained in a single position by permanent magnets 16 and 20, for example, in a position intermediate the two electromagnets 26 and 28. In this case, permanent magnets 16 and 20 would be polarized in the same direction, and the resulting energy distribution from the two permanent magnets 16 and 20 would be as shown in FIG. 6B. As shown in FIG. 6B, member 40 would be maintained at the 0 position. Another example of a monostable element is disclosed in the embodiment of the present invention shown in FIGS. 13 and 14 and discussed hereinafter.

Figure 4:
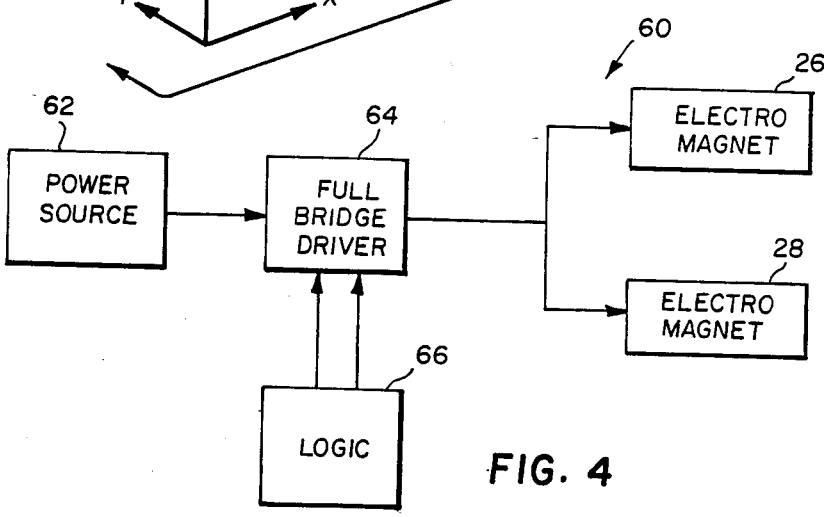
FIG. 4 is a block diagram of the driver for the actuator.

Current is supplied to coils 30 and 34 by means of a driver 60 (FIG. 4) which includes a power source 62, a full bridge driver 64, and logic module 66. Full bridge driver 64 can be, for example, a Model JDN 1953B, obtainable from the Sprague Co., and the logic module 66 can include a dual single shot (not shown) which can be a Model 96LS02, obtainable from the Fairchild Co. In certain applications, actuator 12 is driven by current pulses, and the speed of actuator 12 can be regulated by changing the delay between pulses.

Figure 5:
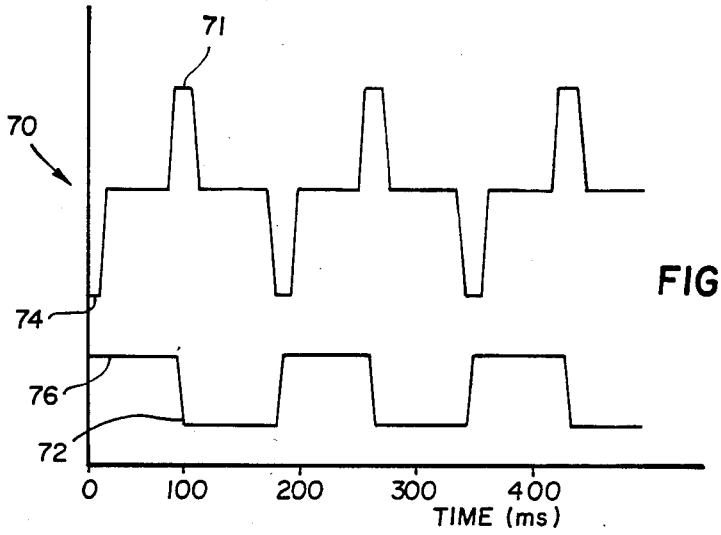
FIG. 5 is a graphical representation showing the movement of the driven member in response pulses from the driver.

With reference to FIG. 5, there are shown a waveform 70 which represents input pulses to actuator 12 and a waveform 73 which illustrates movement of member 40 in response to the pulses in waveform 70. Positive current pulses 71 are provided by driver 60 in actuator 12 to move member 40 to a first position, indicated by lines 72, and negative current pulses 74 are provided by driver 60 to move member 40 to a second position, indicated by lines 76. Actuator 12 can be operated to move member 40 between the two positions in less than 5 milliseconds.

Figure 8A:
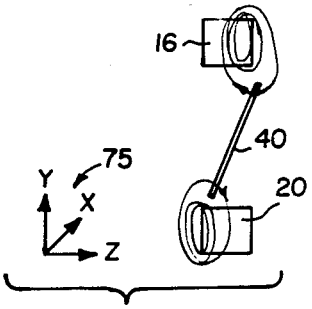
FIGS. 8A–8C are illustrations of the magnetic forces which suspend the driven member along the Z axis.
Figure 8B:
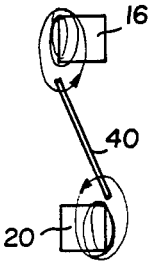
Figure 8C:
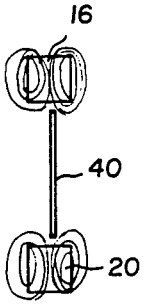

As noted above, the magnetic circuit in actuator 12 incorporates permanent magnets 16 and 18 in a manner to provide a magnetic energy minimum at the rest position of member 40. The magnetic circuit also provides magnetic suspension along one degree of freedom which is, in the case of actuator 12, in a direction normal to the plane of member 40. As a result of the combined effects of the magnetic suspension of member 40 and the low mass of member 40, a minimum of power is required by the electromagnets 26 and 28. In FIGS. 8A–8C, there are shown the magnetic forces from magnets 16 and 20 which support member 40 along the Z axis as defined by diagram 75, that is, in a direction transverse to the path of movement of member 40 and to the plane of member 40. The equilibrium position of member 40 is shown in FIG. 8C. Any tendency of the member 40 to move from the equilibrium position of FIG. 8C will be resisted by the magnetic flux generated by magnets 16 and 20, as shown schematically in FIGS. 8A and 8B, and the member 40 will be maintained in an equilibrium position.

Figure 2:
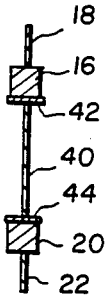
FIG. 2 is a sectional view, taken along the line 2—2 in FIG. 1.

In one representative example of actuator 12, frame 14 is formed from silicon steel, the outside dimensions of frame 14 are approximately 6.096 cm by 3.556 cm, and the thickness of the frame is about 0.018 cm. Permanent magnets 16 and 20 are square in cross section, as viewed in FIG. 2, and each side is approximately 0.3175 cm; the length of magnets 16 and 20 is about 2.286 cm, as viewed in FIG. 1. The material of the permanent magnets 16 and 20 is Ceramic 8, obtainable from the Hitachi Magnets Corp. Each of the coils 30, 34, is formed from 32 AWG copper wire and has approximately 450 windings. Member 40 is formed from silicon steel, the outside dimensions are approximately 1.778 cm by 1.27 cm, as viewed in FIG. 1, the thickness is about 0.0051 cm, and the mass is about 0.087 grams. An actuator of the type described in this example has been used successfully as a shutter in an electronic camera in which the member 40 is driven to open and close the shutter ten times per seconds by current pulses of approximately 0.36 amperes.

Figure 9:
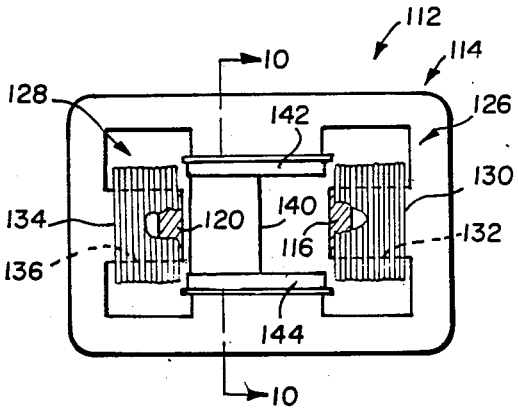
FIG. 9 is a front elevational view of a another embodiment of the present invention.
Figure 10:
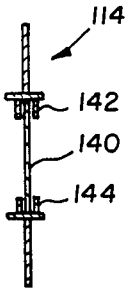
FIG. 10 is a sectional view, taken along the line 10—10 in FIG. 9.

With reference to FIGS. 9 and 10, there is shown a second embodiment of the present invention. As shown in FIG. 9, a magnetic actuator 112 comprises a frame 114, and electromagnets 126 and 128. Electromagnet 126 includes a coil 130 and a core 132 which is integral with frame 114, and electromagnet 128 includes a coil 134 and a core 136 which is integral with frame 114. A permanent magnet 116 is fixed to core 132, and another permanent magnet 120 is fixed to core 136. As shown in FIGS. 9 and 10, a member 140 is adapted to move in tracks 142 and 144 on frame 114. As best shown in FIG. 10, the tracks 142, 144, are shaped to constrain movement of member 140 in a direction transverse to the plane of movement. Due to the location of permanent magnets 116, 120, member 140 is not held in suspension in the plane of movement, as in the embodiment shown in FIG. 1; however, magnets 116 and 120 do produce magnetic forces which tend to hold member 140 in position and thereby reduce the frictional forces imposed on member 140 by the tracks 142 and 144. Actuator 112 can be driven by electrical pulses in a manner similar to that described for actuator 12.

Figure 11:
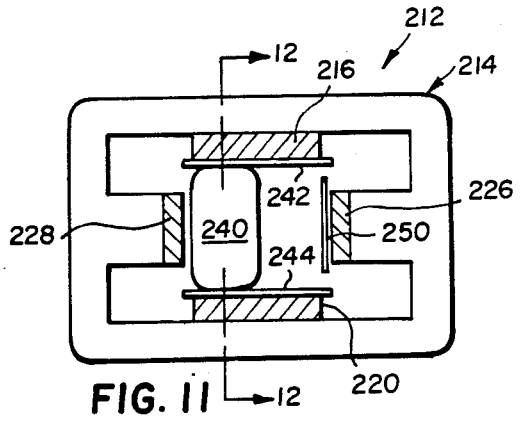
FIG. 11 is a front elevational view of still another embodiment of the present invention.
Figure 12:
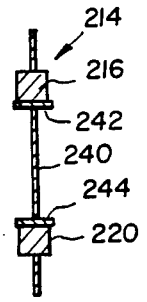
FIG. 12 is a sectional view, taken along the line 12—12 in FIG. 11.

Another embodiment of the present invention is shown in FIGS. 11 and 12. As shown in FIG. 11, an actuator 212 comprises a frame 214 and permanent magnets 216, 220, 226, and 228. A magnetic member 240 is movable on tracks 242 and 244 between a location adjacent magnet 226 to a location adjacent magnet 228. A shield 250 is adapted to be moved into a position beside magnet 226, and another shield (not shown) is adapted to be positioned beside magnet 228. By actuating the shields in sequence, i.e. positioning one shield beside a magnet and withdrawing the other, the member 240 can be made to move between the magnets 226 and 228. Shield 140 can be formed of a material, such as silicon steel, which redirects the flux along the plane of the shield.

Figure 13:
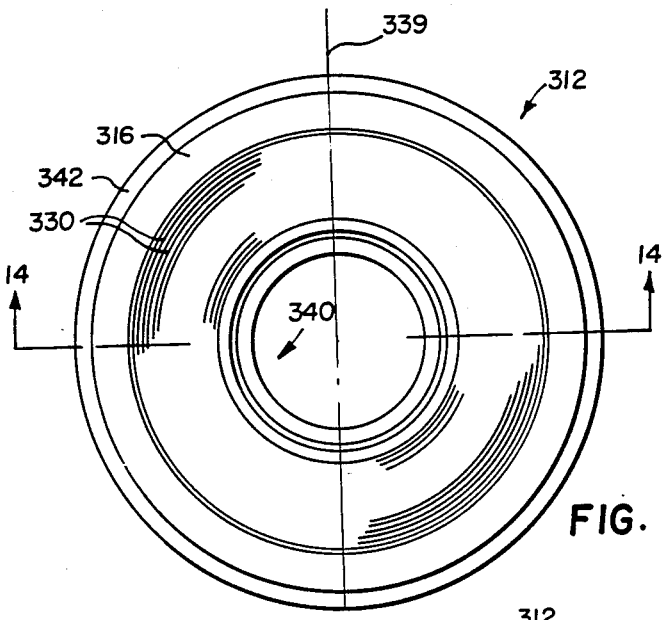
FIG. 13 is a top plan view of a further embodiment of the present invention.
Figure 14:
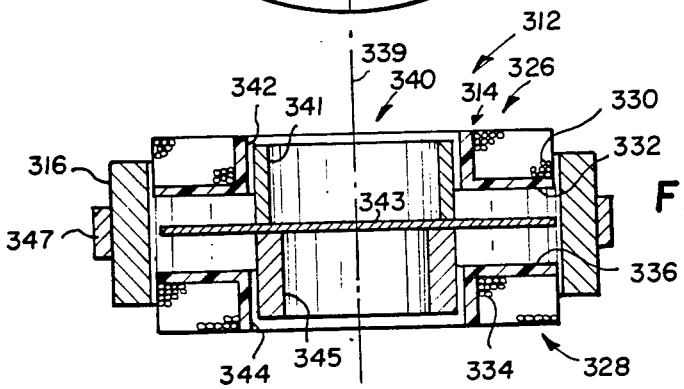
FIG. 14 is a sectional view taken along the line 14—14 in FIG. 13.

A further embodiment of the invention is shown in FIGS. 13 and 14. As shown in FIGS. 13 and 14, a magnetic actuator 312 comprises a member 340 which is movable along an axis 339. Electromagnets 326 and 328 are arranged along axis 339 at opposite ends of the path of travel of member 340. Electromagnet 326 comprises a bobbin 332 fixed to a stationary frame (not shown), and a coil 330 carried on the bobbin 332. Electromagnet 328 comprises a bobbin 336 fixed to a stationary frame (not shown) and a coil 334 carried on the bobbin 336. An annular permanent magnet 316 is mounted around electromagnets 326 and 328, and magnet 316 is radially magnetized. A high permeability steel ring 347 is mounted around magnet 316. Member 340 includes a cylindrical element 341 which is movable on surfaces 342 and 344 of bobbins 332 and 334 respectively, a disc-shaped element 343, and a soft iron washer 345. Actuator 312 is monostable and is maintained in the position shown in FIG. 14 by magnet 316 when no current is supplied to coils 330 and 334. When a current of one polarity is supplied to coils 330 and 334, member 340 moves in one axial direction to a position adjacent one of the electromagnets 326, 328, and when a current of the opposite polarity is supplied to the coils 330 and 334, the member 340 moves in the opposite axial direction to a position adjacent the other one of the electromagnets 326, 328.

Actuators 12, 112, 212, and 312 have been described herein as having stationary frames and movable members 40, 140, 240, and 340. It will be apparent to those skilled in the art that the members 40, 140, 240, and 340, could be held stationary and the frames moved. It will also be apparent to those skilled in the art that the actuators disclosed herein can be moved in nonlinear paths with appropriate modifications in the actuator elements; for example, the movable element (not shown) could be pivotally mounted and the permanent magnets (not shown) curved to move the element in an arcuate path. Further, the present invention can be used in actuators (not shown) which drive a movable member along a plurality of paths.

A magnetic actuator of the type disclosed herein can be used, for example, to drive a shutter blade in photographic apparatus, as disclosed in the aforesaid U.S. patent application, entitled Exposure Control Device, Ser. No. 132,744; such an actuator can also be used to adjust the focus of a lens, as disclosed in the aforesaid U.S. patent application entitled Axial Magnetic Actuator, Ser. No. 132,732

The invention has been described in detail with particular reference to a preferred embodiment thereof, but it will be understood that variations and modifications can be effected within the spirit and scope of the invention.

I claim:

1. A magnetic actuator for providing a driving force along a predetermined path, said actuator comprising:

a member having a substantial portion thereof formed of a magnetic material, said material providing a low reluctance path for magnetic flux;

magnetic means for forming a magnetic circuit adjacent said member, said magnetic means generating magnetic flux in said circuit for suspending said member relative to said magnetic means along one degree of freedom, said magnetic flux resisting any change in the relative positions of said member and said magnetic means along said one degree of freedom; and means for creating an imbalance in said circuit to effect relative movement between said member and said magnetic means.

2. A magnetic actuator, as defined in claim 1, wherein said member is a driven member which moves along said path.

3. A magnetic actuator, as defined in claim 1, wherein said magnetic means includes permanent magnet means.

4. A magnetic actuator, as defined in claim 3, wherein said magnetic means includes a first permanent magnet located on one side of said path and a second permanent magnet located on an opposite side thereof.

5. A magnetic actuator, as defined in claim 4, wherein said first permanent magnet is polarized in a first direction, said second permanent magnet is polarized in a direction opposite to said first direction, and said member is bistable.

6. A magnetic actuator, as defined in claim 4, wherein said permanent magnets are polarized in the same direction and said member is monostable.

7. A magnetic actuator, as defined in claim 1, wherein said magnetic means includes permanent magnets arranged parallel to and on opposite sides of said path, and permanent magnets arranged at opposite ends of said path.

8. A magnetic actuator, as defined in claim 7, wherein said means for creating an imbalance in said circuit includes means for blocking magnetic flux from one of said permanent magnets.

9. A magnetic actuator, as defined in claim 1, wherein said means for creating an imbalance in said circuit includes means for changing the distribution of magnetic flux in said circuit.

10. A magnetic actuator, as defined in claim 9, wherein said means for creating an imbalance in said circuit includes a first electromagnet located at a first point along said path and a second electromagnet located at a second point along said path.

11. A magnetic actuator, as defined in claim 10, wherein means for creating an imbalance in said circuit includes means for energizing said electromagnets.

12. A magnetic actuator, as defined in claim 11, wherein said energizing means includes means for providing a train of pulses to said electromagnets.

* * * * *